United States Patent [19]

Natarajan

[11] 4,265,641

[45] May 5, 1981

[54] METHOD AND APPARATUS FOR PARTICLE CHARGING AND PARTICLE COLLECTING

[75] Inventor: Subbiah Natarajan, Fenton, Mo.

[73] Assignee: Monsanto Company, St. Louis, Mo.

[21] Appl. No.: 40,260

[22] Filed: May 18, 1979

[51] Int. Cl.[3] ..... B03C 3/00

[52] U.S. Cl. ..... 55/2; 55/118; 55/124; 55/103; 55/138; 55/139; 55/152; 55/155; 55/DIG. 39; 55/122; 361/230; 361/235

[58] Field of Search ..... 55/2, 13, 118, 119, 55/124, 126, 136–138, 145, 148, 152, 122, 155, 103, 139, DIG. 39; 361/225, 226, 230–235; 323/8, 81

[56] References Cited

U.S. PATENT DOCUMENTS

| | | | |
|---|---|---|---|
| 1,343,285 | 6/1920 | Schmidt | 55/2 |
| 1,766,422 | 6/1930 | Wintermute et al. | 55/119 |
| 2,364,641 | 12/1944 | Meston . | |
| 2,874,802 | 2/1959 | Gustafssonet et al. | 55/13 |
| 2,949,168 | 8/1960 | Peterson . | |
| 2,978,066 | 4/1961 | Nodolf | 55/15 |
| 3,026,964 | 3/1962 | Penney | 55/152 |
| 3,555,818 | 1/1971 | Vliei . | |
| 3,653,185 | 4/1972 | Scott et al. . | |
| 3,717,977 | 2/1973 | Stone . | |
| 3,745,749 | 7/1973 | Gelfand | 55/105 |
| 3,765,154 | 10/1973 | Hardt et al. . | |
| 3,783,588 | 1/1974 | Hudis | 55/DIG. 39 |
| 3,820,306 | 6/1974 | Vincent . | |
| 3,907,520 | 9/1975 | Huang et al. . | |
| 3,910,778 | 10/1975 | Shahgholi et al. . | |
| 3,918,939 | 11/1975 | Hardt . | |
| 3,958,960 | 5/1976 | Bakke . | |
| 3,958,962 | 5/1976 | Hayashi | 55/152 |
| 3,980,455 | 9/1976 | Masuda . | |
| 4,077,782 | 3/1978 | Drummond . | |
| 4,094,653 | 6/1978 | Masuda | 55/152 |
| 4,119,416 | 10/1978 | Hayashi et al. | 55/136 |
| 4,126,430 | 11/1978 | Kelichi | 55/152 |
| 4,222,748 | 9/1980 | Argo et al. . | |

FOREIGN PATENT DOCUMENTS

| | | | |
|---|---|---|---|
| 2635789 | 2/1978 | Fed. Rep. of Germany | 55/138 |
| 477177 | 12/1937 | United Kingdom | 55/139 |
| 830573 | 3/1960 | United Kingdom | 55/119 |

*Primary Examiner*—Bernard Nozick
*Attorney, Agent, or Firm*—Lawrence L. Limpus

[57] ABSTRACT

Method and apparatus for charging and collecting submicron particles. The particles are charged by a needle-to-plate ionizer having offset rows of needles which are spaced from the plate such that voltage gradients of 6 KV/cm and higher are achieved. Needle-to-needle spacing and effective area of the plate are such that a corona current having a density of at least 4 ma/m$^2$ flows between the needles and the plate. Circuitry is provided that in combination with the ionizer quickly quenches arcs while maintaining the voltage across the ionizer. Charged particles are collected in a collecting section having a deflector electrode and a pair of collecting plates. The deflector electrode includes a conductor embedded in a dielectric material having a dielectric constant greater than 1, which dielectric material suppresses arcs between the deflector electrode and the collecting plates.

68 Claims, 20 Drawing Figures

METHOD AND APPARATUS FOR PARTICLE CHARGING AND PARTICLE COLLECTING

BACKGROUND OF THE INVENTION

This invention relates to apparatus for removing particles from a gas stream and more particularly to apparatus for charging and collecting submicron particles entrained in a gas stream.

Gas streams, particularly in industrial settings, often contain particulates which must be removed therefrom for environmental or other reasons. Large particles, i.e. above 1–3 microns in size, are relatively easy to separate from the gas stream and conventional apparatus can remove them with high efficiency. Submicron particles, on the other hand, are more difficult to remove and the collection efficiencies of conventional apparatus with respect to them are lower.

Various types of apparatus are used to collect submicron particles, some with relatively high efficiency, but they do have disadvantages. These apparatus typically use an ionizer to charge the particles and then provide a large surface area at a different potential to collect them. However, high charges on submicron particles are difficult to achieve in conventional ionizers. The voltage gradient and current densities of these ionizers are not generally sufficient to quickly and highly charge submicron particles. In many cases this charging can be increased only at the expense of undesirably increased power consumption. Consequently, these apparatus either have a relatively long transit time (e.g., seconds) for particles in the ionizer, which is obtained by flowing the gas stream through the apparatus at a low velocity, or they have a large amount of collection area to collect the less highly charged particles, or both. These alternatives are all undesirable since they require a larger apparatus to handle a given amount of gas than would be required if the particles were more highly and rapidly charged (e.g., in milliseconds). In addition, apparatus with large collection areas typically have high distributed capacitances. Arcs and sparkovers occurring in such apparatus are sustained by the charges stored in the apparatus.

Some apparatus have electrodes for generating a precipitating field downstream of the ionizer to increase the rate at which charged particles move toward the collecting surface. But these electrodes create another problem, viz., arcing and sparking 20 between the electrodes and the collecting surfaces. During arcing the precipitating fields decrease and particles go uncollected.

SUMMARY OF THE INVENTION

Among the several objects of the invention may be noted the provision of apparatus which is very effective in charging submicron particles; the provision of such apparatus which highly charges submicron particles with minimal power consumption; the provision of such apparatus which minimizes the number of submicron particles which pass through the apparatus without being highly charged; the provision of such apparatus which quickly quenches sparkovers in the charging area; the provision of such apparatus which has relatively low corona suppression even at high particle loadings; the provision of apparatus which maintains the voltage in the charging area even during sparkovers and arcing; the provision of apparatus which generates high precipitating fields for collection of charged particles; the provision of such apparatus which suppresses sparkovers and arcs in the collecting section of the apparatus; and the provision of such apparatus which has high collection efficiency for submicron particles with a relatively small collecting area.

Briefly, in a first aspect apparatus of the invention comprises at least one substantially planar plate constituting a plate electrode for connection to one terminal of a high voltage, unidirectional-current source, a plurality of substantially evenly spaced-apart needles forming a corona discharge electrode for connection to the other terminal of the source, and a passage defined by the plate and the needles for flow therethrough from an inlet to an outlet thereof of a gas stream containing particles to be charged. During operation an electrostatic field is formed between the needles and the plate and a corona current flows therebetween. The needles are disposed substantially parallel to the plate and spaced from the plate a distance such that the voltage gradient of the electrostatic field during operation is at least 6 KV/cm. The needles are arranged in at least first and second groups, the needles of the second group being offset transversely to the direction of flow of the gas stream. The effective area of the plate and the spacing between adjacent needles is such that the corona current has a current density of at least 4 ma/m$^2$. During operation high corona current density and high voltage gradient of the electrostatic field are achieved, corona suppression is reduced, high particle charges are achieved, and a minimal amount of electrical power is consumed.

In a second aspect the present invention comprises a system for quick recovery from arcing and sparkover conditions in an ionizer having a corona discharge electrode, a plate electrode, and relatively low capacitance. This system includes a high voltage, unidirectional-current power supply for connection to the corona discharge electrode and the plate electrode to impress a high operating voltage thereacross to create an electric field and a corona current between the corona discharge electrode and the plate electrode. The power supply includes protective circuitry for automatically opening the circuit between the power supply and the ionizer during arcing and sparkover conditions to quench any arcs and sparkovers and then automatically reclosing the circuit. The system also includes means for maintaining the voltage across the discharge and plate electrodes above some predetermined level for a predetermined length of time but without supplying sufficient current to the ionizer to maintain an arc or sparkover for the predetermined length of time, whereby the voltage across the discharge and plate electrodes quickly recovers to the operating voltage once any arcs and sparkovers are quenched and the circuit between the ionizer and the power supply is reclosed.

In a third aspect apparatus of the invention comprises a non-corona deflector electrode for connection to a first terminal of a high voltage, unipolar source, the first terminal having the same polarity as the charges on substantially all charged particles entrained in a gas stream. The apparatus also includes at least one collecting plate disposed substantially parallel to the deflector electrode for connection to the other terminal of the source. The collecting plate and deflector electrode have an air gap therebetween for passage of the gas stream in which the charged particles are entrained.

When the collecting plate and the deflector electrode are connected to the terminals they create an electrostatic field across the air gap for deflecting the charged particles in the air gap toward the collecting plate. The deflector electrode includes at least one conductor for connection to the first terminal. This conductor is separated from the air gap by a layer of dielectric material having a dielectric constant greater than that of air. During operation sparkover between the deflector electrode and the collecting plate is suppressed and high electrostatic fields therebetween are achieved.

Other objects and features of the invention will be in part apparent and in part pointed out hereinafter.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
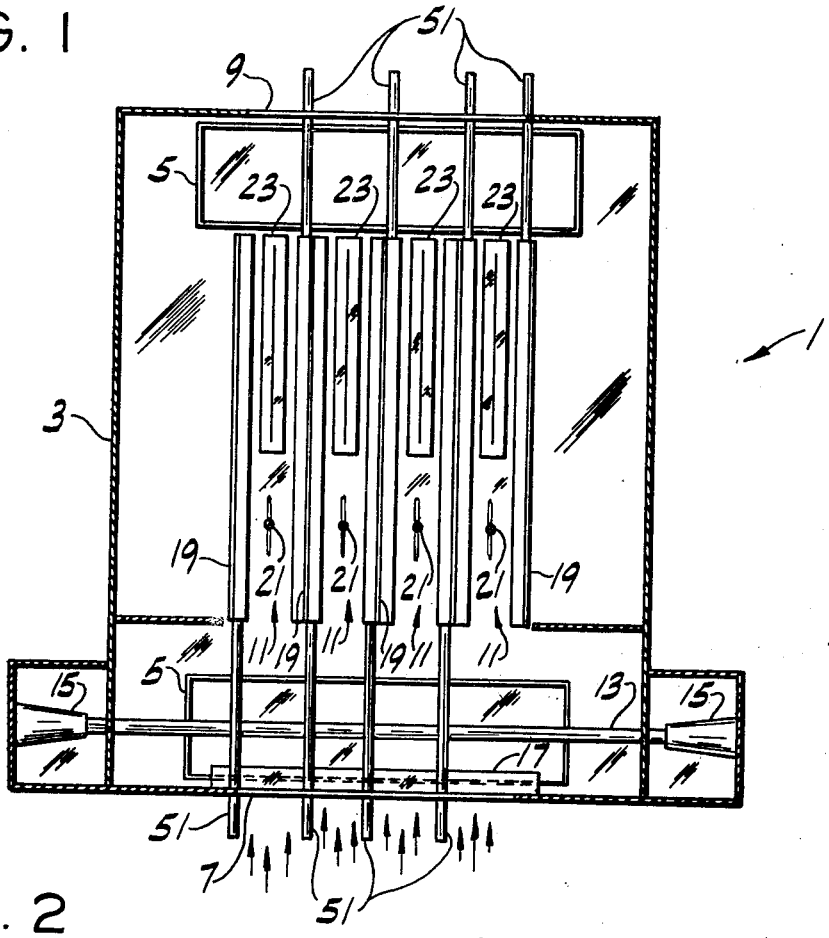
FIG. 1 is a top plan, with parts removed of particle collecting apparatus.
Figure 2:
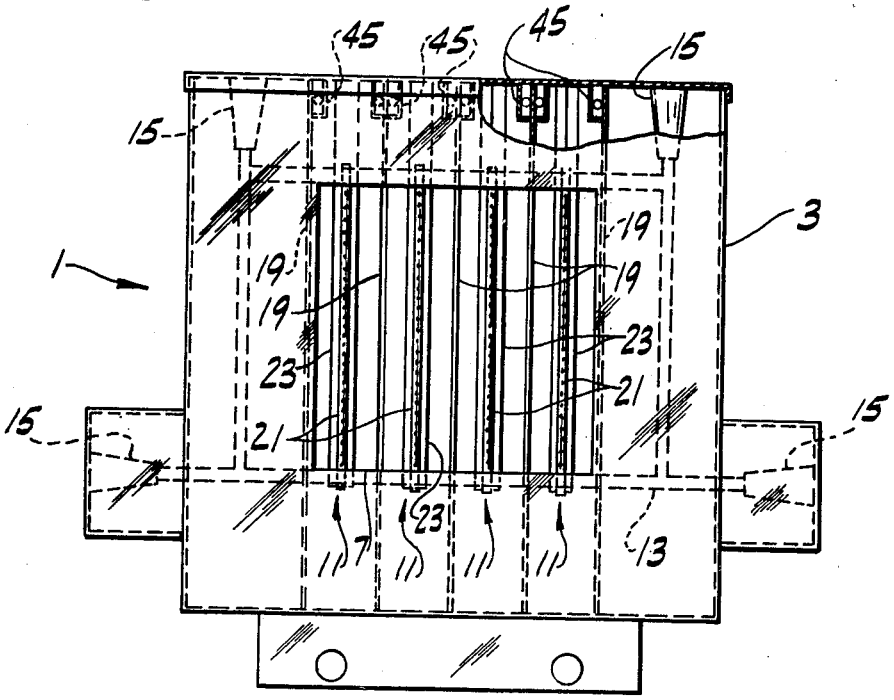
FIG. 2 is a front elevation of the apparatus of FIG. 1.

Referring now to the drawings, there is shown in FIGS. 1 and 2 an apparatus 1 for removing particulates, and particularly insoluble particulates, from a gas stream. This apparatus includes a housing 3, two drain wells 5, an inlet 7 for entrance of the gas stream into the apparatus, an outlet 9 for exit of the stream from the apparatus, and a plurality (in this case, four) collecting sections 11 arrayed in a bank to provide a plurality of parallel paths for the gas stream. Sections 11 are also sometimes called ionizer sections. A frame 13, having stand-off insulators 15, is provided to support sections 11 and for making the necessary electrical connections.

A gas stream (indicated by arrows throughout the Figs.), having entrained therein particles to be charged and collected, continuously enters inlet 7, is directed by top and bottom baffles 17 (only the bottom of which is shown) toward sections 11, and is there split up into four, smaller gas streams for flow through the collecting sections. Each collecting section is defined by a pair of substantially parallel plates 19, and has disposed therebetween a high-intensity, needle-to-plate corona discharge electrode 21 and a deflector electrode 23. Discharge electrode 21 is disposed generally near the inlet end of the section while deflector electrode 23 is disposed generally downstream from the discharge electrode along the direction of flow of the gas stream. The discharge electrode includes a plurality of evenly spaced-apart needles 25 (see FIG. 3) arranged in a first row or group pointing generally upstream and a plurality of evenly spaced-apart needles 27 arranged in a second row or group pointing generally downstream. Both rows are secured to a rigid mount or tube 28 of insulative or conductive material, said tube being generally perpendicular to the direction of flow of the gas stream and generally parallel to plates 19. When mount 28 is of insulative material, there is disposed inside the mount a conductor 28A electrically connected to the needles of both rows. The needles may be of various sizes and shapes, but it is preferred that the needles have body diameters between 10 mils (0.025 cm) and 100 mils (0.25 cm), and more preferably between 30 mils and 75 mils. Excellent results have been achieved with needles having body diameters of 47 mils (0.12 cm). It is preferred that the needles have a taper angle measured from the longitudinal axis in the range of from 3° to 10°. Excellent results have been achieved with sharp needles having a taper angle of 4.3°. Needles 25 and 27 are parallel to each other and to plates 19 and are perpendicular to tube 28.

Figure 4:
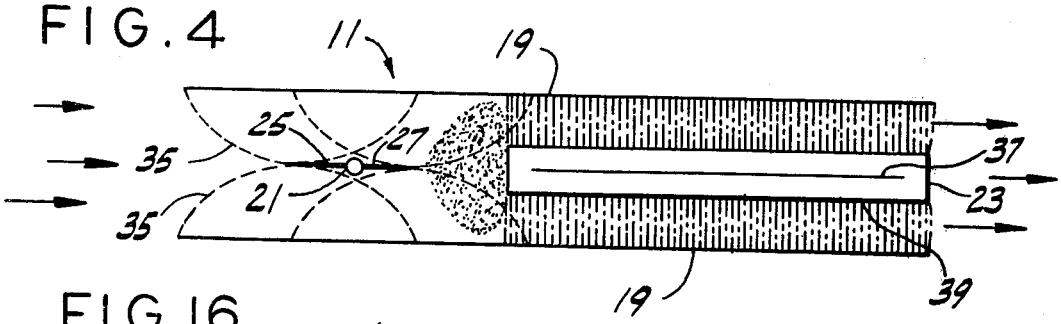
FIG. 4 is a schematic representation in plan of a single collecting section used in the apparatus of FIG. 1 showing the ionized regions and precipitating fields.
Figure 11:
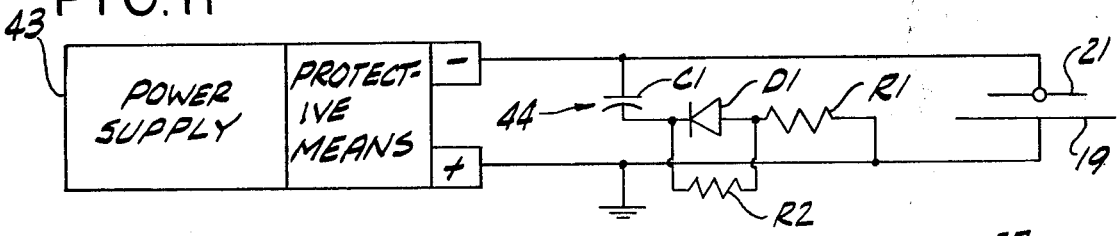
FIG. 11 is a schematic diagram of a circuit for maintaining the voltage across the ionizer of the apparatus of FIG. 1 during arcing conditions.

An enlarged view of a collection section is shown in FIG. 4. In operation discharge electrode 21 and plates 19 are connected to terminals of a high voltage source, e.g. a power supply such as is shown in FIG. 11, to form an electrostatic field between the discharge electrode and the plates and to cause a corona current to flow therebetween. It is preferred that the potential of the discharge electrode with respect to the plates, which plates function as plate electrodes, generally always retain the same polarity and that the corona current generally always flow in the same direction during operation. Accordingly, the high voltage source is preferably unipolar, (i.e., the relative polarity of the output terminals of the source does not change during operation). Specifically, discharge electrode 21 is connected to one terminal of a high voltage, unidirectional-current (i.e., pure DC or rectified current) which source is also unipolar, and the plates are connected to an other or opposite terminals of the source (i.e., to a terminal which is grounded or has a potential different from the potential of the terminal connected to the discharge electrode). It is preferred, especially when the gas stream contains electronegative gases, that the polarity of the discharge electrode with respect to the plates be negative and that the plates themselves be connected to the ground terminal of the high voltage source. Of course, the discharge electrode may be operated with a positive polarity and the plates need not be grounded—indeed the plates may have a high voltage imposed upon them which is of opposite polarity to that imposed upon the discharge electrode—but very satisfactory operation is achieved using the preferred connection of the discharge electrode and the plates.

It is preferred that the voltage difference between the discharge electrode and plates 19 be in the vicinity of 30 kilovolts (30KV) and that the spacing between plates 19 be on the order of 3 inches (3 in.) (8 cm). The present invention is certainly not limited to such operating voltages and plate spacings, however. With correspondingly wider plate spacing, apparatus within the scope of this invention may be operated at higher voltages such as 100 KV; and with correspondingly narrower plate spacing, such apparatus may be operated at voltages less than 30 KV. Even at 30 KV, the plate spacing need not be precisely 3 in. (8 cm). Discharge electrode 21 is disposed between and generally equidistant from plates 19 with its needles generally parallel to each other and to the plates. In the preferred embodiment, the spacing between the needles and the plates is approximately 1.5 in. (3.8 cm) and the voltage gradient therebetween (i.e., the mean gradient of the average voltage) is approximately 7.9 KV/cm. Generally, this voltage gradient should be in the range of from 6 KV/cm to the breakdown gradient of the gaseous medium, and it is preferred that it be in the range of from approximately 7 KV/cm to 15 KV/cm, and it is further preferred that the gradient be in the range of from approximately 7.5 KV/cm to 10 KV/cm. Excellent results have been achieved with voltage gradients of approximately 7.9 KV/cm and approximately 8.7 KV/cm.

For efficient charging of particles, particularly particles 0.5 micrometers (microns) in size and larger, it is desirable to have the voltage gradient between the needles and plates 19 as great as possible without significant arcing and sparkover occurring between the needles and the plates. Once the preferred range set forth above is significantly exceeded, arcing becomes such a problem that performance of the apparatus (measured in terms of particle charging and collection) degrades significantly. It is also desirable that the electrostatic field formed between the discharge electrode and the plates extend for some distance along the path of the gas stream to adequately charge these relatively large particles. In apparatus having the dimensions set forth above, needles 25 and needles 27 should extend from tube 28 at least ½ in. (1.3 cm) to provide a field of sufficient length. Of course the longer the needle, the better for this purpose; but for compactness and because of manufacturing tolerances it is desirable that the length the needle extends from the tube not exceed 3 in. (7.6 cm), and preferably not exceed 1½ in. (3.8 cm). Very satisfactory results have been achieved at 30 KV with the exposed length of the needles being 1 in. (2.5 cm).

Whenever a high voltage gradient, e.g., 8 KV/cm, exists between the needles and the plates, each needle of the discharge electrode (specifically, the tip of each needle) emits a corona. Because of the spacing between adjacent needles, these needle coronas do not combine to form one or two continuous coronas but rather form a first spatially discontinuous corona 29 (see FIG. 3) disposed toward the inlet end of collecting section 11 and extending from the top to the bottom of the section and a second spatially discontinuous corona 31 disposed downstream from said first corona, also extending from the top to the bottom of the section. These discontinuous coronas create first and second bands of ionization, each extending generally from top to bottom of section 11, which bands are generally identical in shape (the shape of either being shown in FIG. 3A). Each contains regions of relatively low ionization, indicated by the reference numeral 33, bordered by regions of relatively high ionization, indicated by reference numeral 35. The high ionization regions are generally centered on their respective coronas and extend from the tips of the needles to each plate.

Figure 3:
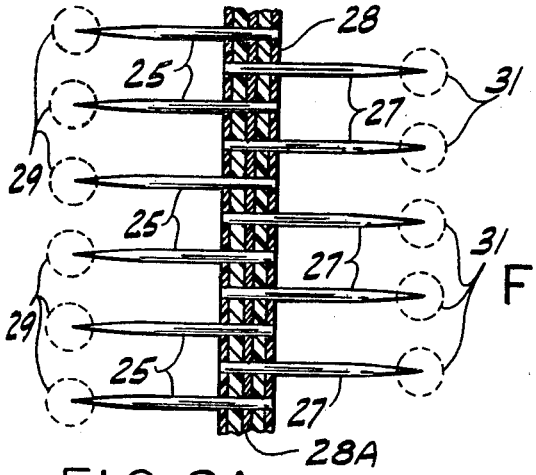
FIG. 3 is a cross-sectional view of a needle discharge electrode used in the apparatus of FIG. 1.

The high ionization regions of each band in combination with the high voltage gradient of the electrostatic field are very effective in charging submicron particles, particularly those less than 0.5 microns in size, whereas the low ionization regions are much less effective. Therefore, if such a particle were to pass discharge electrode 21 without entering a high ionization section, it could leave the area of the discharge electrode without having picked up a substantial charge. To reduce this possibility, the needles of the discharge electrode are offset (as shown in FIG. 3) so that the low ionization regions of each band are aligned with the high ionization regions of the other band. It has been found that merely offsetting needles 25 from needles 27 is not sufficient to maximize the possibility that submicron particle entrained in the gas stream will pass through a highly ionized region. It is also necessary to optimize the spacing between adjacent needles in each row. As the needles of a row are spaced farther apart, the corona current per needle increases and to a point the corona current density per unit area of the plate electrodes also increases. Since the degree of ionization is directly related to the magnitude of the corona current, this increase is desirable. However, increasing the spacing also increases the number of particles that bypass the high ionization regions of the discharge electrode and thus fail to become sufficiently charged. Conversely, decreasing the spacing decreases the number of particles that pass the discharge electrode without being charged but also decreases the corona current. The optimum charging is not achieved at the needle-to-needle spacing that gives the highest corona density but rather at a somewhat shorter spacing that provides a sufficient level of charging of particles with a minimum of particle bypassing. It has been found that for operation at approximately 30 KV with the present system, the best balance between these competing effects is achieved with a needle-to-needle spacing in each row of from approximately ⅜ in. (0.9 cm) to approximately 1 in. (2.5 cm). It is preferred that this spacing be from approximately ½ in. (1.3 cm) to approximately ¾ in. (1.9 cm). Good results were achieved with a spacing of ½ in. (1.3 cm).

Figure 5:
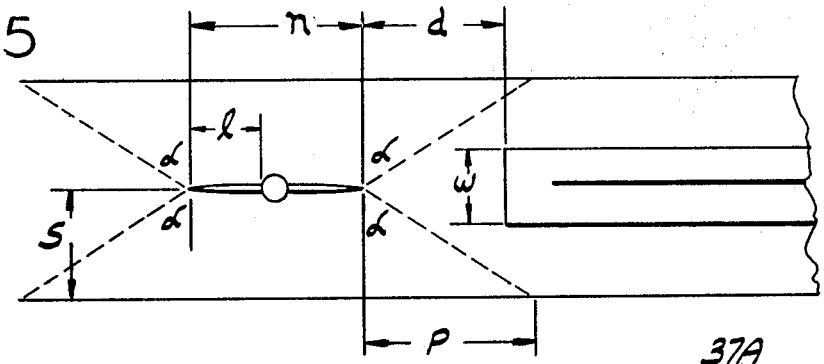
FIG. 5 is a schematic representation on a larger scale of a portion of the collecting section of FIG. 4.

When needles 25 and 27 are offset one half the needle-to-needle spacing of each row from each other and the needle-to-needle spacing itself is optimized as described above, it has been found that very high corona current densities are achievable with a minimum of non-corona emission and with little or no corona suppression under both constant and surging high particulate loading. Corona currents having a density of at least 4 ma per square meter of the effective area of plates 19 are easily achievable with the present apparatus and current densities of 20 ma/$m^2$ and higher are possible in particle-free gas streams. Notice should be taken that these current density figures are computed using the "effective areas" of plates 19. The effective area of a plate is determined according to the following formula:

$$\text{Effective area} = h \times (n + 2P),$$

where h is that portion of the height of the plate exposed to the gas stream, n is the distance measured parallel to the needles from the tip of the needles of one row to the tip of the needles of the other row (see FIG. 5), and 2P is the distance along the plate upstream and downstream of the needles where significant current flow between the needles and the plates occurs. Of course, some current flow will take place between the needles and those areas of the plates beyond the distance P, but this current can be neglected. The distance P in turn is computed using the formula $P = S \times \tan \alpha$, where $\alpha$ is an angle in the range of from approximately 45° to approximately 65°, and S is the distance from the needles to each plate. It is preferred that this angle be about 62°. Plates of shorter length can, or course, be used but there is some decrease in efficiency.

As the particles pass the needles of the discharge electrode, they come under the influence of the deflector electrode. Deflector electrodes, or precipitating electrodes, are used in the art to generate a field which forces charged particles to a collecting plate or plates. Deflector electrode 23 does serve this function and its precipitating field is shown by stress lines on FIG. 4. It has been discovered, however, that the spacing d (see FIG. 5) between the needle electrode and the deflector electrode is very important, as is the width W of the deflector electrode itself. When d is in the range of from $\frac{1}{4}$ the plate-to-plate spacing (or equivalently $\frac{1}{2}$ the spacing S between the needles and each plate) to approximately the plate-to-plate spacing (i.e., 2S), a decelerating field is produced which opposes the motion through the collecting section of the particles charged by the discharge electrode. This results in an increase in the space charge, indicated by the speckled cloud in FIG. 4, between the discharge and deflector electrodes and in an increase in the precipitating fields in the same region. In addition the electric fields and ion densities in that region are made more uniform. As a result, particles are even more likely to pass through a region of high ionization, and they are subjected to the fields and ions for a longer period of time than is the gas in which they are entrained. Consequently, higher particle charging is achieved. Thus, deflector electrode 23 is also a decelerating electrode. It is preferred that this spacing d be at least $\frac{2}{3}$ S, and more preferably be in the range from approximately 0.75 S to approximately 1.5 S. If spacing d is less than the distance 0.75 S, the possibility exists that current from the needles will sustain a sparkover between electrode 23 and plates 19. The desired width W of the deflector electrode, which is the maximum distance across the electrode measured perpendicular to the plates, may also be selected advantageously to be in the range of from 1/20 of the plate-to-plate spacing to approximately $\frac{1}{2}$ said spacing. Excellent results have been achieved with W equal to $\frac{1}{3}$ the plate-to-plate spacing and d equal to $\frac{2}{3}$ said spacing.

Figure 6:
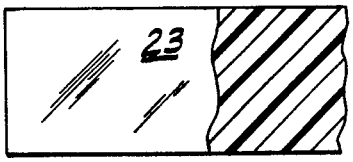
FIGS. 6 and 6A are plans of segments of alternative electrodes used in the apparatus of FIG. 1 with parts of the surfaces broken away.
Figure 6A:
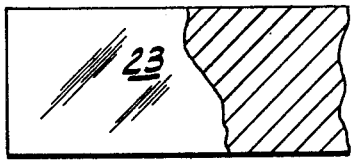

For purposes of serving the decelerating and precipitating functions, deflector electrode 23 may be any shape and be either an insulator (see FIG. 6) or a conductor (see FIG. 6A) or some sort of composite electrode. And electrode 23 need not be used in conjunction with discharge electrode 21. Indeed it may be used to precipitate and decelerate charged particles created by any kind of ionizer. However, it is preferred that electrode 23 have the constructions shown in FIGS. 7–10. The deflector electrode shown in FIGS. 7 and 8 includes a thin film 37 (e.g., 0.001 in.) of a conductor such as aluminum embedded or encapsulated in a dielectric material 39 having a dielectric constant greater than air and a volume resistivity of at least $10^7$ ohm-cm. It is preferred that the dielectric material have a dielectric constant in the range of from approximately 2.5 to approximately 9 and a volume resistivity of at least $10^{13}$ ohm-cm. In choosing a dielectric material to use in electrode 23, it is desirable to choose a material having a high dielectric constant and good mechanical strength so that the thickness of the material over the conductor can be made as thin as possible (to increase the magnitude of the precipitating field) while still protecting against rupture of the dielectric during arcing between the deflector electrode and the plates (which rupturing would require replacement of the deflector electrode). Very satisfactory results have been obtained using a one inch (2.5 cm) thick piece of polymethylmethacrylate as the dielectric material, the aluminumm foil being embedded therein approximately 0.5 in. (1.3 cm) from each surface. Any dielectric having a dielectric constant and a volume resistivity in the above ranges would be useful in the deflector electrode, including without limitation alumina, other ceramics, glasses, polymeric materials, mineral and fiber-filled polymeric and resin materials, resins, natural and synthetic rubbers, and thermosetting resins. Among the multitude of useful materials are polyethyleneterephthalate polyvinylchloride, perfluorinated polymers, polycarbonates, polysulfonates, nylon, polyurethane, polyvinylacetals such as polyvinylbutyral and polyvinylformal, phenol formaldehyde, aminoplasts, and polyester and epoxy resins. Also, liquid dielectric materials such as transformer oil may be used to cover conductor 37, in which situation the dielectric must be contained in a case, which case may be either conductive or nonconductive.

Although the shape of deflector electrode 23 is not critical, it is preferred that it be generally flat and parallel to the plates and that conductor 37 be generally the same shape as the electrode itself, although somewhat smaller. As shown in FIG. 4, an air gap exists between the deflector electrode and each plate and a precipitating electric field, indicated by stress lines, fills these gaps. It is preferred that this field be such as to cause the particles charged by the discharge electrode to be forced towards the plates rather than towards the deflector electrode. To accomplish this it is necessary that electrode 23 build up a charge having the same polarity as the charges on the particles. The preferred way of doing this is to connect conductor 37 to a terminal of the high voltage source having the same polarity as the discharge electrode and the charges on the particles. When so connected, a high voltage difference exists between the conductor and the plates, which voltage difference creates the precipitating fields.

Of course, the conductor need not be embedded in a dielectric to produce these precipitating fields; a bare conductor will also generate these fields when connected to the high voltage source. However, a bare conductor has one problem that is substantially eliminated with deflector electrodes of the present construction, namely, arcing between the deflector electrode and the plates. With electrodes of the present construction, the dielectric material acts as a current limiting resistance between the conductor and the plates. This material limits the amount of current that can flow between the conductor and the plates to such a low value that arcs are not readily generated and if generated cannot be sustained. It has been found that if the dielectric material is an electret such as polymethylmethacrylate, not only are arcs and sparkovers suppressed but also the precipitating fields are maintained even during temporary losses of voltage from the high voltage source.

Figure 7:
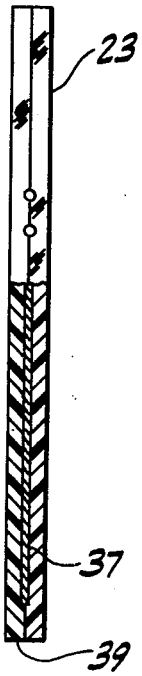
FIG. 7 is a front elevation, with part of the surface broken away of a precipitating electrode used in the apparatus of FIG. 1.
Figure 8:
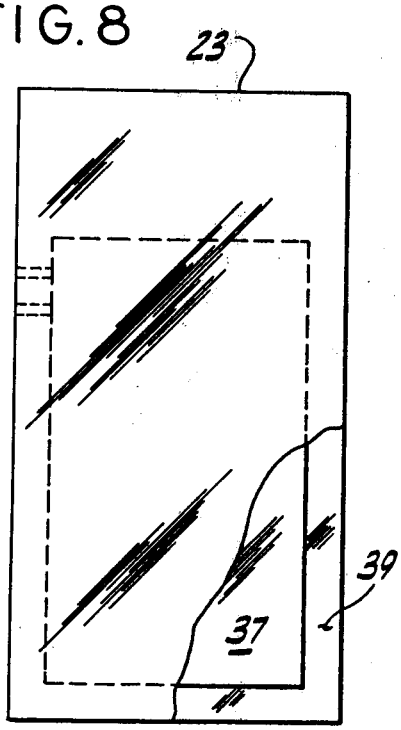
FIG. 8 is a side elevation of the electrode of FIG. 7 with part of the electrode broken away.
Figure 9:
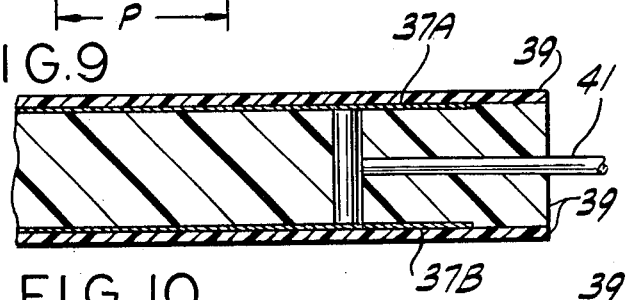
FIG. 9 is a cross section on a larger scale than FIGS. 7 and 8 of an electrode having a construction alternative to that of the electrode of FIGS. 7 and 8.
Figure 10:
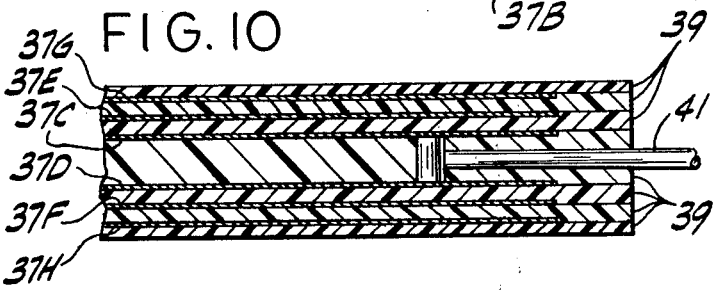
FIG. 10 is a cross section on the same scale as FIG. 9 of another electrode having a construction alternative to that of the electrode of FIGS. 7 and 8.

The deflector electrodes shown in FIGS. 9 and 10 are alternative embodiments of that shown in FIGS. 7 and 8. Externally they are substantially identical to the deflector electrode of FIGS. 7 and 8, but they differ internally. The electrode of FIG. 9 includes two foil conductors 37A and 37B, each embedded in a dielectric material 39 a predetermined distance, e.g., 1/16 in. (0.2 cm), below the surface of the electrode and connected by a conductor 41 to the high voltage source. Accordingly each conductor is spaced the same distance from its respective plate as the other, but neither is disposed in the center of the electrode. This construction results in a much thinner layer of dielectric between the conductors and their associated airgaps, and hence in stronger precipitating fields.

The electrode shown in FIG. 10 is similar to that of FIG. 9 except that it includes six conductors 37C–37H embedded in the dielectric, only the innermost two of which (conductors 37C and 37D) are connected to the high voltage source. The conductors lying nearest the surface of the electrode (conductors 37G and 37H) are completely insulated from those conductors directly connected to the high voltage source.

Figure 3A:
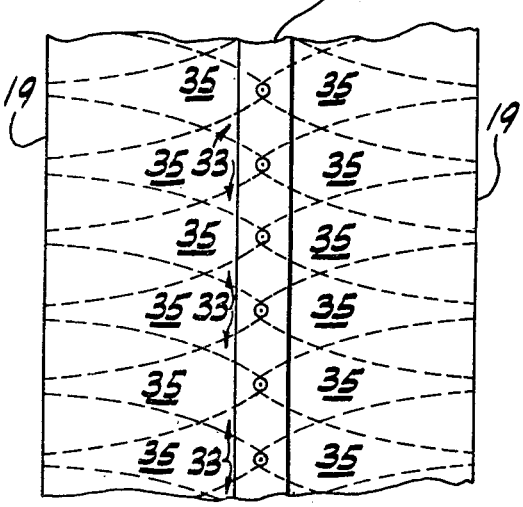
FIG. 3A is a schematic representation of the regions of ionization created by the discharge electrode of FIG. 3 during operation.

When deflector electrodes having the constructions shown in FIGS. 7–10 are used in combination with the high-intensity discharge electrode shown in FIGS. 3 and 3A, very high efficiencies of collection of submicron particles are obtained with a small effective collecting area. In the present embodiment, that collecting area is the area of plates 19 and for each collecting section 11 is equal to 17.5 square feet/1000 cubic feet per minute of gas (17.5 sq. ft./1000 cfm) (1.6 square meters/1000 cfm). Generally with the present apparatus, the total collecting area per collecting section is between approximately 3 and approximately 50 square feet/1000 cfm (0.28 to 4.6 sq. m/1000 cfm), and preferably is between 10 and 30 square feet/1000 cfm (0.93 to 2.8 sq. m/1000 cfm). More preferably this collecting area is in the range of from 15 to 20 square feet/1000 cfm (1.4 to 1.86 sq. m/1000 cfm). Of course, additional collecting area [e.g., up to 500 square feet/1000 cfm (46 sq. m/1000 cfm) or higher] can be added to achieve even higher efficiencies.

It should be appreciated that the distributed capacitance of the ionizer of the present apparatus, which ionizer is constituted by discharge electrode 21 and plates 19, has a very low distributed capacitance. In the example shown in the drawings, the plates themselves are only 16 in. (41 cm) in length, and even when this entire length is taken into account the distributed capacitance of the ionizer is only 467 picofarads (467 pF) per 1000 cfm. Consequently the ionizer itself does not have enough charge stored therein to long maintain an arc once one starts. Since conventional high voltage power supplies, such as power supply 43 shown in FIG. 11, include circuitry for automatically opening the circuit between the power supply and the ionizer during arcing and for automatically closing said circuit once the arc is quenched (which circuitry is indicated by the legend "protective means" in FIG. 11); the present apparatus quickly quenches any arcs that do occur.

The low distributed capacitance of the ionizer, although it does have the beneficial effect outlined, above, also has an undesirable effect. When an arc does occur, the voltage between the discharge electrode and the plates drops precipitously. As a result particles passing the discharge electrode at that time might not become fully charged. Particularly when the gas is flowing through the apparatus at a high flow rate, e.g., 10 feed/second (10 ft/sec) (3 m/sec), a particle can flow past the discharge electrode while there is no significant voltage gradient existing between the electrode and the plates. In apparatus operated at a slower gas flow rate, this is not as significant a problem; but at high flow rates the problem becomes very important. At 10 ft/sec (3 m/sec), a particle to be charged passes the discharge electrode in approximately 25 milliseconds (25 msec) and passes through the effective length of the ionizer, which is $n+2d$, (8 in. (20 cm) in the present example), in approximately 0.06 seconds. If the voltage between the discharge electrode and plates 19 is low for a large portion of that time, most of the particles passing through the collecting section will remain substantially uncharged. This is the reason why ionizers are typically operated slightly below the level at which a significant amount of sparkover occurs. If one operates in the sparkover region, the number of particles that pass through uncharged will be substantial since the voltage between the discharge electrode and the plates will often be low.

To solve the problem of voltage loss after sparkover, means indicated at 44 (see FIG. 11) have been developed for maintaining the voltage across the discharge electrode and the plates above some predetermined level, e.g., 26 KV, for a predetermined length of time, e.g., 16 msec or longer, but without supplying sufficient current to the ionizer to maintain an arc or sparkover for the predetermined length of time. Means 44 includes a capacitor C1, a resistor R1, and a high voltage diode D1, which are connected in series with each other across the discharge electrode and plates 19. The capacitor has a capacitance of, e.g., 0.1 to 1.0 microfarads (0.1 to 1.0 micro-F) and preferably 0.3 to 0.4 micro-F, and during normal operating conditions it is charged to nearly the operating voltage of 30 KV. During arcing the charge on capacitor C1 serves to maintain the voltage across the discharge electrode and the plates at a relatively high level. Merely connecting a capacitor across the discharge electrode and the plates does not solve the problem however. This would simply provide a source of additional charges for the ionizer which would maintain the arc. Accordingly, resistor R1, having a resistance of. e.g., 1–10 megohms (1–10 M-ohms) and preferably 3 M-ohms, is connected in series with the capacitor. This limits the current that can flow through the capacitor to a value sufficiently low that arcs are not maintained. Additionally, a high voltage diode such as diode D1, which is forwardly biased in normal operating conditions, may be added to this series circuit to further limit the current which flows through the capacitor during arcing. The leakage through diode D1, which is inherent in high voltage diodes, serves to provide additional ions to the region near the discharge electrode during arcing conditions, which further promotes charging of the particles passing the discharge electrode at that time. Additionally, a second resistor R2 (e.g., having a resistance of 10–20 M-ohms) may be added in parallel with diode D1 to provide some leakage across the diode. Of course, adding capacitor C1 does lower the sparkover voltage between the discharge electrode and the plates somewhat. But the sparkover voltage with the present discharge electrode is so high that this does not severely affect the operation of the apparatus. Although the capacitor and resistor can in general have a range of values, it is preferred that their RC time constant be between approximately 16 msec and approximately 900 msec. In the preferred embodiment the RC time constant is 300 msec.

It should be appreciated that some way of cleaning plates 19, either periodically or continuously, is necessary. In the absence of cleaning, a surface charge builds up on the plates and affects performance. These plates can be cleaned by rapping or washing and the like, but it is preferred that they be continuously irrigated with a thin film of liquid such as water or some other wash liquor. Since the plates in this example are approximately 16 in. (41 cm) in length, it has proved difficult to obtain a substantially even and uniform film of liquid over the length of each plate. This problem is compounded by the fact that squirting or splashing of the liquid is highly undesirable due to the very small spacings between the discharge electrode and the plates on one hand and the deflector electrode and the plates on the other. Less than two inches (5 cm) away from the liquid on the plates (in this example) is an electrode at 30 KV. Clearly splashing or squirting of the liquid onto the plates in such circumstances is intolerable. But the elimination of splashing and squirting cannot be had at the expense of leaving portions of the collecting plates dry, since that is also undesirable.

This washing dilemma has been solved by a new wash header, alternative embodiments of which are shown in FIGS. 12–15. Although designed for use in irrigating collecting plates of particle collecting apparatus, the wash header is not so limited in application. Rather it can be used wherever a substantially uniform and continuous film or curtain of liquid is needed. This wash header can supply a substantially uniform film or curtain of liquid along a surface or in general along any horizontal path or line whether or not that path or line is associated with a surface.

Figure 13:
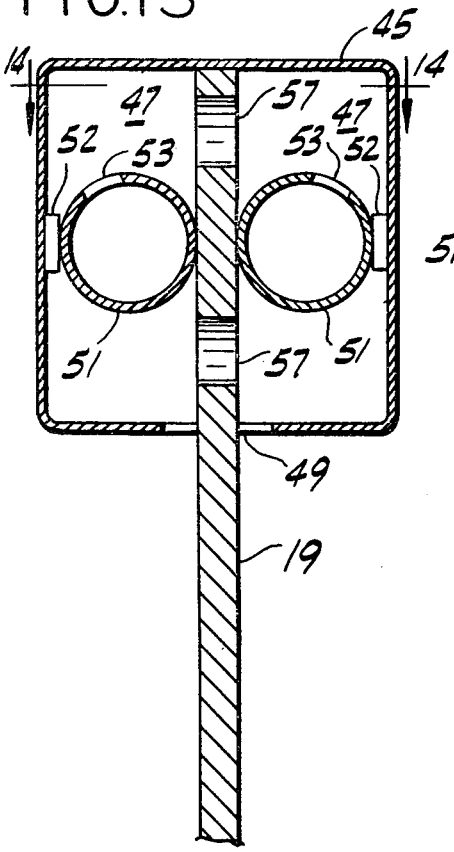
FIG. 13 is a cross-sectional view of the wash header of FIG. 12.
Figure 12:
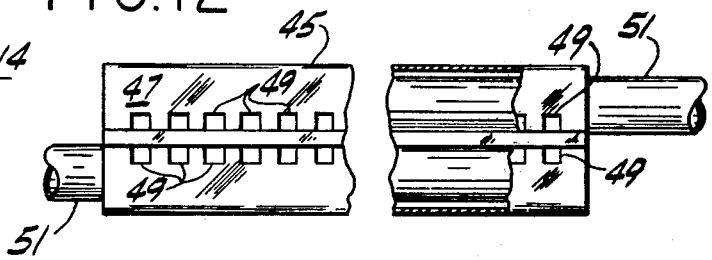
FIG. 12 is a bottom plan, with parts broken away and on a reduced scale, of a wash header for irrigating the collecting plates of the apparatus of FIG. 1.
Figure 14:
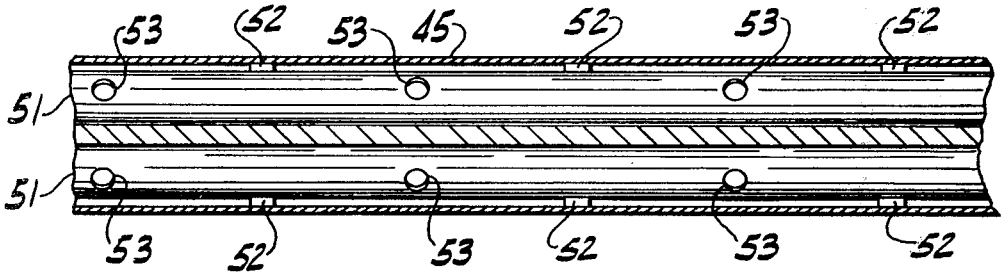
FIG. 14 is a cross-sectional view, taken along lines 14—14 of FIG. 13, of a portion of the wash header of FIGS. 12 and 13.

The first embodiment of the wash header, wash header 45, has a dual form, shown in FIGS. 12–14 and a single form (not shown) which is simply one half of the dual form. Single wash headers 45 are used to irrigate the leftmost and rightmost collecting plates 19 shown in FIG. 1, while dual wash headers are used to irrigate both sides of the intermediate plates. Each half of wash header 45 includes a closed, low pressure (e.g., 6 inches of water) chamber 47 extending generally along the surface, path or plate 19 to which liquid is to be supplied. Chamber 47 has a plurality of relatively large apertures 49, which in the preferred embodiment are ¼ in. (0.6 cm) square slots disposed adjacent the surface of the plate to be irrigated at the lower end of the chamber. The slots are evenly spaced along the plate and the space between adjacent slots in approximately ¼ in. (0.6 cm). Of course the slots need not be square or even of any particular shape, and the space between adjacent slots may be varied as desired. Indeed the apertures may take the form of a single slit broken by spacers. Apertures 49 allow liquid in chamber 47 to drain out of the chamber uniformly and at relatively low pressure. Each half of wash header 45 also includes a high pressure line 51 for carrying the liquid at relatively high pressure [e.g., 20 pounds per square inch (20 psi) (1400 grams per square centimeter)] to the low pressure chamber. Spacers 52 are disposed periodically along line 51 to maintain it in position inside the low pressure chamber. Preferably line 51 extends generally along the length of chamber 47 and has a plurality of 0.086 in. (0.22 cm.) holes or orifices 53 (see FIG. 14) therein spaced on 4" (10 cm) centers which constitute means for discharging liquid into the chamber. The actual size and spacing of orifices 53 is not critical. What is important is that the size of the orifices relative to the size of the apertures in the low pressure chamber is such that the pressure drop through the orifices is approximately twenty or more times the pressure drop through the apertures and also approximately twenty or more times the pressure drop from the first orifice in the high pressure line to the last. The low pressure chamber evens out most inequalities in the amount of liquid flowing out of the orifices, so that it is not even necessary that all the orifices be exactly the same size. The relative insensitivity of the low pressure chamber to pressure differences in the high pressure line also makes the functioning of the wash header 45 rather free from effects caused by pressure surges in that line. On a very long header, however, consideration should be given to making the orifices at the end of the high pressure line larger than those at the beginning to roughly or approximately equalize the amount of liquid discharged from each orifice.

Figure 15:
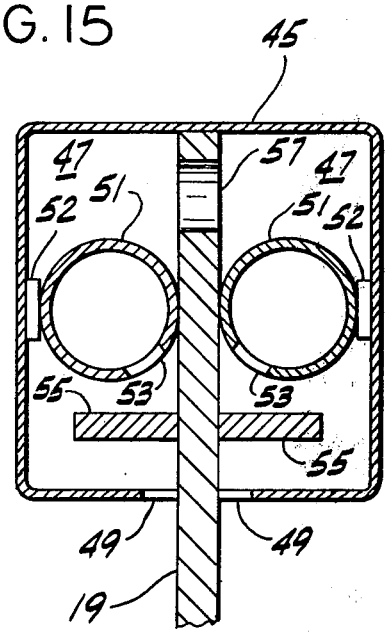
FIG. 15 is a cross-sectional view, similar to FIG. 13, showing an alternative construction of the wash header of FIGS. 12–14.

Although the high pressure line need not be disposed wholly inside the low pressure chamber, that arrangement is preferred. When the line is so disposed, the orifices thereof are directed generally away from the apertures in the low pressure chamber so as not to cause splashing and squirting of liquid out of the apertures. Alternatively, as shown in FIG. 15, a baffle 55 may be added to low pressure chamber 47 to shelter apertures 49 from liquid being discharged downwardly from the orifices in this embodiment.

In the dual form, wash header 45 includes a plurality of 5/16 in. (0.8 cm) holes or openings 57 generally spaced on 4 in. (10 cm) centers between the two chambers 47 making up a dual wash header, which openings constitute means for equalizing the pressures in the two chambers. A single high pressure line can be used to supply liquid to both low pressure chambers of a dual wash header, but it is preferred that each half of the wash header have its own high pressure line as is shown in FIG. 1. Periodically, one end of each high pressure line may be opened for passage through that line of a high pressure surge of liquid for cleaning out the line.

Particles attracted to collecting plates 19 and those forced to the plates by the precipitating fields of the deflector electrodes are caught by the liquid flowing uniformly over the plates from the wash headers and are carried away from the plates and down drain wells 5 before they can be re-entrained into the gas stream.

The substantially particle-free gas stream then exits from the apparatus at outlet 9 (see FIG. 1).

Figure 16:
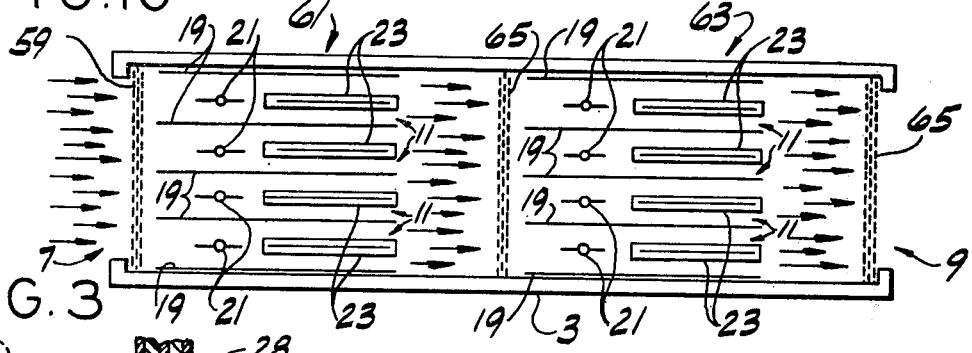
FIG. 16 is a schematic representation in plan of an apparatus containing two stages, each including the collecting apparatus of FIG. 1.

Apparatus 1 collects a substantial fraction of all the particles entrained in a gas stream; but to achieve very high collection efficiencies on submicron particles (e.g., 95% or higher) with minimal power consumption it is desirable to use a two-stage system such as is shown in FIG. 16. This system includes an initial set of baffles 59, a first stage 61, and a second stage 63 all disposed inside housing 3. The first and second stages may be but are not necessarily substantially identical, each consisting generally of an apparatus 1 followed by a set of baffles 65. Since the particles entering the second stage are of much smaller mean particle size than those entering the first stage and since the inlet loading is also lower, the second stage may be designed with these different parameters in mind. A gas stream flowing into housing 3 first passes through baffles 59 which remove relatively large particles (e.g., 10+ microns) from the stream. Then the stream passes through the collecting sections 11 of the first stage where most of the smaller particles in the gas stream are collected on collecting plates 19. Some particles do remain entrained in the gas stream as it exits from the collecting sections, but most of these particles have been highly charged by discharge electrodes 21. It has been found that these highly charged, submicron particles can be efficiently collected on baffles. Baffles 65, therefore, constitute means in addition to collecting plates 19 for collecting charged submicron particles. Of course, other means such as fiber beds, packed-bed scrubbers or any other conventional particle collectors may be used to collect particles outside collecting sections 11, but baffles are preferred.

Figure 17:
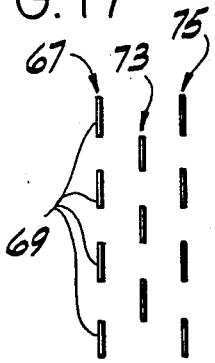
FIG. 17 is a schematic representation, on an enlarged scale, of a portion of a set of baffles used in the apparatus of FIG. 16.
Figure 18:
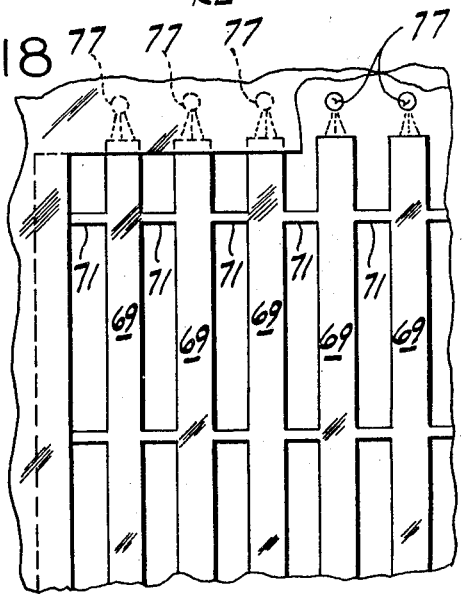
FIG. 18 is a front elevation of a portion of one row of the baffles of FIG. 17.

Baffles 65 have been designed to maximize particle collection with minimal pressure drop. The detail of baffles 65 is shown more clearly in FIGS. 17 and 18. These baffles include a first row 67 of generally vertical strips 69 of generally equal width, [e.g., ¼ in. (0.6 cm)], each strip extending generally perpendicular to the direction of flow of the gas stream and generally from the top to the bottom of housing 3. Row 67 extends from side to side of the housing and the strips thereof form a plurality of slots having a width equal to the width of the strips [(e.g., ¼ in. (0.6 cm)]. A number of small crosspieces 71 (see FIG. 18) extend between adjacent strips and provide structural integrity to row 67. These crosspieces should have as small a profile as possible to obtain nearly equal open and closed areas for each row. A second row 73 of strips, which are substantially identical to the first row but offset so that the strips of the second row are aligned with the slots in the first row, are disposed downstream from the first row a distance in the range of from approximately 0.8 times to approximately 3 times the width of the strips and slots [e.g., 0.2 in. to ¾ in. (0.5 cm to 1.9 cm)]. The strips of the second row form targets for the charged submicron particles that pass through the slots in the first row. The baffles also include a third row 75, which is substantially identical to the first and second rows, disposed downstream of the second row a distance in the range of from approximately 0.8 times to approximately 3 times the width of the strips and slots of each row. The strips of the third row are aligned with the slots in the second row along the direction of flow of the gas stream to form targets for the charged particles which remain uncollected after the second row. For adequate collection of submicron particles the width of the slots and strips in each row of the baffles should be no more than 1 in. (2.5 cm) and it is preferred that this distance be approximately ¼ in. (0.6 cm).

It is desirable that the strips of each row be periodically or continuously cleaned to prevent a build-up of charge that would reduce their collection efficiency. Means for cleaning, specifically means for irrigating, the baffles are indicated at 77 (see FIG. 18). Irrigating means 77 includes a plurality of nozzles for spraying irrigating liquid on the baffles. In the case of the baffles, there is no need to use the wash headers for irrigation since the baffles may be spaced some distance from the nearest high voltage source. In irrigating the baffles, however, it is desirable to spray irrigating water only on the strips and not in the slots, because in the latter case the irrigating liquid itself becomes entrained in the gas stream.

A series of tests have been performed to determine the overall efficiency of the system shown in FIG. 16 as well as the various parts making up the stream. In these tests, DOP aerosol, fly ash, sinter dust (ferric and ferrous oxide particles), and other insoluble particles were used to provide the particles for the gas stream. Excellent results were achieved on all these types of particles. The results of those tests are summarized below. Operating the two-stage system of FIG. 16 at 30 KV, with a total specific collection area in square feed per 1000 cfm of gas flow of forty, simultaneous collection efficiencies of over 99% on particles 1 micron and larger in size and of over 98% on submicron particles have been achieved with less than a 2" of water pressure drop and a power consumption of less than 1 KW/1000 cfm of gas. Similar results, also showing the effect of the quick voltage recovery circuit shown in FIG. 11, are set forth in Table I.

TABLE I

| | GAS | | IONIZER | | | | | | | | | FRACTIONAL EFFICIENCIES** | | | | |
|---|---|---|---|---|---|---|---|---|---|---|---|---|---|---|---|---|
| RUN | FLOW RATE cfm ($m^3$/min) | VELOCITY ft/sec (m/sec) | VOLTS KV | AMPS Milliamps | POWER Actual KW | POWER KW PER 1000 CFM (Kw/1000 $m^3$/min) | SYSTEM PRESSURE DROP IN. $H_2O$ (Kg/$m^2$) | OVERALL EFFICIENCY % | LOADING* Inlet mg/$m^3$ | LOADING* Exit mg/$m^3$ | <0.2 % | 0.1–0.25 % | 0.25–0.4 % | 0.4–0.75 % | 0.75–2.0 % |
| 2 | 600 (17) | 10 (3) | 30 | 15 | 0.45 | 0.75 (0.02) | 1.3 (33) | 98.15 | 419 | 7.75 | 93.83 | 96.02 | 97.39 | 98.70 | 99.39 |
| 1 | 600 (17) | 10 (3) | 30 | 15 | 0.45 | 0.75 (0.02) | 1.3 (33) | 98.18 | 394 | 7.19 | 95.0 | 96.32 | 97.56 | 98.63 | 99.61 |

*Inlet particle mass mean diameter of micron, with 84% of the particles by weight being less than 3.2 microns
Fractional efficiencies measured by cascade impacter for a number of particle mass mean diameter sizes measured in microns Table I reflects two runs of the system, the first with an inlet particle loading of 419 mg/m3 of sinter dust and the second with a loading of 394 mg/m3 of sinter dust. During the first run capacitor C1 had a value of 0.025 micro-F and in the second it had a value of 0.32 micro-F. In both runs there was heavy arcing and sparking between the discharge electrodes and the collecting plates 19** caused by a lack of clean irrigation liquid. This condition started at the end of the first run and continued throughout the second. Nevertheless, overall collection efficiencies of over 98% were achieved, as were efficiencies of over 95% for all particles except those less than 0.2 microns in size. Even for particles of that size, the collection efficiencies exceeded 93% for both runs.

Some of the excellent results achieved by the present system, which includes discharge electrode 21, plates 19, deflector electrode 23 and baffles 65, are attributable to the high intensity ionizer consisting of discharge electrode 21 and collecting plates 19. Voltage gradients in the ionizer of this example are preferably in the range of from 7.8 KV/cm to 8.7 KV/cm, and the concomitant corona current densities are in the range of from 10.8 ma/m$^2$ to 15.0 ma/m$^2$. This high gradient and current density result in extremely high particle charges as measured by the ratio of particle charge to mass. For particles with a mass mean diameter of 0.6 micron, as measured after a single stage of section 11, values of this ratio of from 700 to 900 micro-coulomb/gm (micro-C/gm) have been measured. These charges were achieved using particles having a mass mean diameter at the inlet of section 11 of 1.0 micron with 84% thereof having a mass mean diameter of less than 2.2 microns, with an inlet loading of 225 mg/m$^3$. These high particle charges result in high collection rates on the collection plates and baffles and a resulting very low specific collection area for the system. In addition corona suppression with the present ionizer is very small. At 30 KV the corona current of the ionizer was suppressed about 20%, when the total specific surface area of the particles present in the gas stream was about 1 m$^2$ per cubic meter of gas, which corresponds to an inlet loading of 450 mg/m$^3$, with a mass mean diameter of the particles of 1 micron, 84% of the particles having a mass mean diameter of less than 2.1 microns. Even the suppressed current density was above 10 ma/m$^2$.

The ionizer by itself does a fairly good job of collecting particles entrained in the gas stream. Tests were run on the collection efficiency of an ionizer having a specific collection area (in square feet per 1000 cfm of gas) of only 9 (0.8 m$^2$/1000 cfm) at three different operating voltages. In each case the incoming particles had a mass mean diameter of 1 micron and 84% of the particles had a mass mean diameter of less than 2.2 microns, the gas flowed through the apparatus at a rate of 10 feet per second (3 m/sec), and the inlet loading was 225.0 mg/m$^3$. At 27 KV, the ionizer alone had an overall collection efficiency of over 65%; at 30 KV the overall efficiency was over 72%; and at 33 KV the overall collection efficiency was over 77%. The particle charges measured at the ionizer exit (i.e., on the particles not collected by the ionizer) were 90, 120 and 160 micro-C/gm at 27, 30 and 33 KV respectively.

Tests were also run at 30 KV on the collection efficiency of a single discharge electrode in combination with a single deflector electrode. The particles introduced into the gas stream during these tests had a mass mean diameter of 1.0 micron with 84% of the particles having a mass mean diameter of less than 2.1 microns and the inlet loading was 225 mg/m$^3$. Flow rate of the gas stream was 10 feet/sec (3 m/sec) and the effective collecting area of the deflector electrode was 8.75 ft.$^2$/1000 cfm (0.8 m$^2$/1000 cfm). It was determined that this apparatus by itself had an efficiency of 86% on 0.4 to 0.75 micron particles, 94% on 0.75 to 1.2 micron particles, 98.2% on 1.2 to 2.0 micron particles, and 99.8% on 2.0 to 3.5 micron particles. It should be noted that the particle charge to mass ratio measured at 30 KV at the ionizer exit in this example was over 900 micro-C/gm. These results, when compared with those achieved with the ionizer alone, show the substantial increase in the particle charging resulting when discharge electrode 21 is used in combination with deflector electrode 23.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A method for charging submicron and larger particles in a gas stream, comprising:

providing a plurality of substantially evenly spaced-apart needles secured to a tube of insulative material disposed generally perpendicular to the direction of flow of the gas stream forming a corona discharge electrode, arranging said needles in at least first and second groups, the needles of the first group being offset with respect to the needles of the second group longitudinally to the direction of flow of the gas stream, providing plate electrodes spaced from said corona discharge electrode to define a passage for flow of said gas stream therethrough, connecting said plate electrodes to one terminal of a high voltage, unidirectional-current source and said corona discharge electrode to the other terminal of said source, generating an electrostatic field between said corona discharge electrode and said plate electrodes having a high voltage gradient of at least 6 KV/cm and extending along a path of the gas stream for a predetermined distance, generating a first spatially discontinuous corona generally towards the upstream end of the electrostatic field to create a first band of ionization in said path and extending transversely thereacross, said band containing regions of relatively low ionization bordered by regions of relatively high ionization, said low ionization regions being substantially evenly spaced along said band transverse to the path of the gas stream, generating a second spatially discontinuous corona downstream of the first corona in the electrostatic field to create a second band of ionization in said path and extending transversely thereacross, said second band containing regions of relatively low ionization bordered by regions of relatively high ionization, the regions of relatively high ionization of the second band being aligned along the path of the gas stream with the regions of relatively low ionization of the first band and the regions of relatively low ionization of the second band being aligned along the path of the gas stream with the regions of relatively high ionization of the first band, the total corona current density of the discontinuous coronas being at least approximately 4 ma/m$^2$, and passing the gas stream containing particles to be charged along the path through said electrostatic field and said bands of ionization to highly charge substantially all the submicron and larger particles in the gas stream.

2. The method as set forth in claim 1 wherein the spatially discontinuous coronas have negative polarity.

3. A method as set forth in claim 1 wherein the predetermined distance is at least 2.5 cm (1 in.).

4. The method as set forth in claim 1 wherein the total corona current density of the discontinuous coronas is in the range of from approximately 10.8 ma/m$^2$ to approximately 20 ma/m$^2$.

5. The method as set forth in claim 1 wherein the voltage gradient of the electrostatic field is in the range of from approximately 7.9 KV/cm to approximately 8.7 KV/cm.

6. The method as set forth in claim 1 wherein a particle in the gas stream on the average flows through said electrostatic field in less than approximately 0.20 sec.

7. The method as set forth in claim 6 wherein a particle in the gas stream on the average flows through said electrostatic field in approximately 0.06 sec.

8. The method as set forth in claim 1 wherein the gas stream passes through the electrostatic field at a velocity of at least approximately 2.6 m/sec. (8.5 ft./sec.).

9. The method as set forth in claim 8 wherein the velocity of the gas stream is in the range of from approximately 2.6 m/sec (8.5 ft/sec) to approximately 4.6 m/sec (15 ft/sec).

10. The method as set forth in claim 9 wherein the gas stream flows through the electrostatic field at a velocity of approximately 3 m/sec. (10 ft./sec.).

11. Apparatus for charging submicron and larger particles in a gas stream comprising at least one substantially planar plate constituting a plate electrode connected to one terminal of a high voltage, unidirectional-current source; a plurality of substantially evenly spaced-apart needles forming a corona discharge electrode connected to the other terminal of said source thereby to form an electrostatic field between said needles and said plate and to cause a corona current to flow therebetween; said needles of said corona discharge electrode being secured to a tube of insulative material disposed generally perpendicular to the direction of flow of the gas stream; and a passage defined by said plate and said needles for flow therethrough from an inlet to an outlet thereof of a gas stream containing particles to be charged; said needles being disposed substantially parallel to said plate and spaced from said plate a distance such that the voltage gradient of the electrostatic field during operation is at least 6 KV/cm, said needles being arranged in at least first and second groups, the needles of the first group being offset with respect to the needles of the second group transversely to the direction of flow of the gas stream, the effective area of the plate and the spacing between adjacent needles being such that the corona current has a current density of at least 4 ma/m$^2$, whereby during operation high corona current density and high voltage gradient of the electrostatic field are achieved, corona suppression is reduced, high particle charges are achieved, and a minimal amount of electrical power is consumed.

12. Apparatus as set forth in claim 1 further including a set of irrigated baffles disposed generally downstream of the plate for collecting the submicron and larger particles charged by the ionizer.

13. Apparatus as set forth in claim 1 wherein the distance between adjacent needles in a group is in the range of from approximately 0.9 cm (⅜ in.) to approximately 2.5 cm (1 in.), thereby resulting in high efficiency charging of submicron and larger particles with minimal consumption of power.

14. Apparatus as set forth in claim 13 wherein the distance between the needles and the plate is approximately 3.8 cm (1.5 in.) whereby the voltage gradient of the electric field between the needles and the plate is in the range of from approximately 7.9 KV/cm to approximately 8.7 KV/cm when the apparatus is operated with a voltage of from approximately 30 KV to approximately 33 KV between the plate and the needles.

15. Apparatus as set forth in claim 13 wherein the distance between adjacent needles in a group is in the range of from approximately 1.3 cm (½ in.) to approximately 1.9 cm (¾ in.), whereby the corona current flowing from the needles has a density of from approximately 10.8 ma/m$^2$ to approximately 20 ma/m$^2$ when the apparatus is operated with a voltage of approximately 30 KV between the needles and said plate.

16. Apparatus as set forth in claim 1 wherein the diameters of the needles' bodies are in the range of from approximately 0.075 cm (30 mils) to approximately 0.19 cm (75 mils).

17. Apparatus as set forth in claim 13 wherein the bodies of the needles have diameters in the range of from approximately 0.025 cm (10 mils) to approximately 0.25 cm (100 mils).

18. Apparatus as set forth in claim 17 wherein each needle has a taper angle at the tip in the range of from approximately 3° to approximately 10°.

19. Apparatus as set forth in claim 1 wherein a substantial fraction of the needles have an effective length of from approximately 1.3 cm (½ in.) to approximately 7.6 cm (3 in.), said effective length of a needle being the projection along a line parallel to the direction of flow of the gas stream of the portion of said needle's surface between which surface and the plate an electrostatic field exists during operation.

20. Apparatus as set forth in claim 19 wherein the needles are disposed substantially parallel to the direction of flow of the gas stream and the effective length of the needles is no greater than approximately 3.8 cm (1½ in.).

21. Apparatus as set forth in claim 1 further including a second substantially planar plate substantially parallel to and spaced from the first plate, said second plate being at substantially the same potential as the first plate during operation, the needles being disposed intermediate said first and second plates, the needles being substantially parallel to and substantially equidistant from said plates to create during operation an electrostatic field and a corona current density between the needles and the second plate having substantially the same magnitudes as the electrostatic field and corona current density existing during operation between the needles and the first plate.

22. Apparatus as set forth in claim 21 wherein the distance between the first and second plates is approximately 7.6 cm (3 in.) and the distance between the needles and each plate is approximately 3.8 cm (1.5 in.), whereby the voltage gradient of the electric fields between the needles and the first plate and between the needles and the second plate is in the range of from approximately 7.9 KV/cm to approximately 8.7 KV/cm when the apparatus is operated with a voltage of from approximately 30 KV to approximately 33 KV between the plates and the needles.

23. Apparatus as set forth in claim 21 wherein the offset is approximately one-half the first distance.

24. Apparatus as set forth in claim 21 wherein the needles are secured to a rigid mount, said mount being disposed substantially parallel to the plates for supporting the needles in position with respect to said first and second plates.

25. Apparatus as set forth in claim 21 wherein the needles of said first group are arranged in a first row and the needles of said second group are arranged in a second row, each row extending transversely of the direction of flow of the gas stream, the needles of the first row pointing upstream into the gas stream flow and the needles of the second row pointing downstream.

26. Apparatus as set forth in claim 25 wherein said first and second rows are substantially perpendicular to the direction of flow of the gas stream.

27. Apparatus as set forth in claim 21 wherein the corona discharge electrode and the first and second plates constitute a first ionizer section, said apparatus further including a plurality of additional ionizer sections, each substantially identical to the first ionizer section.

28. Apparatus as set forth in claim 27 wherein the ionizer sections are disposed in at least one ionizer bank to provide a plurality of parallel passages for the gas stream.

29. Apparatus as set forth in claim 28 further including a second ionizer band disposed downstream of the first bank along the direction of flow of the gas stream.

30. Apparatus as set forth in claim 1 further including a high voltage unidirectional-current power supply for connection to said corona discharge electrode and said plate electrode to impress a high operating voltage thereacross to form an electrostatic field and to cause a corona current to flow between the corona discharge electrode and the plate electrode, said power supply including protective circuitry for automatically opening the circuit between the power supply and the ionizer during arcing and sparkover conditions to quench any arcs and sparkovers and then automatically closing said circuit, and means for maintaining the voltage across the discharge and plate electrodes above some predetermined level for a predetermined length of time but without supplying sufficient current to the electrodes to maintain an arc or sparkover for the predetermined length of time, whereby the voltage across the discharge and plate electrodes quickly recovers to the operating voltage once any arcs and sparkovers are quenched and the circuit between the ionizer and the power supply is reclosed.

31. Apparatus as set forth in claim 30 wherein the maintaining means includes a capacitance connected across the discharge and plate electrodes.

32. Apparatus as set forth in claim 31 wherein the capacitance connected across said electrodes is substantially greater than the distributed capacitance of the ionizer.

33. Apparatus as set forth in claim 31 wherein the maintaining means includes a resistance connected in series with the capacitance across the discharge and plate electrodes.

34. Apparatus as set forth in claim 33 further including a high voltage diode biased forwardly during non-arcing conditions and connected in series with the capacitance and the resistance across the discharge and plate electrodes.

35. Apparatus as set forth in claim 33 wherein the RC time constant of the resistance and capacitance is in the range from approximately 16 msec. to approximately 900 msec.

36. Apparatus as set forth in claim 35 wherein said RC time constant is in the range of from approximately 75 msec to approximately 500 msec.

37. Apparatus as set forth in claim 36 wherein said RC time constant is approximately 300 msec.

38. Apparatus as set forth in claim 31 wherein the maintaining means further includes a diode biased forwardly during non-arcing conditions and connected in series with the capacitance across the discharge and plate electrodes.

39. Apparatus as set forth in claim 38 wherein the polarity of the discharge electrode is negative.

40. Apparatus as set forth in claim 30 wherein the ionizer has a distributed capacitance of no more than 0.01 micro-F.

41. The apparatus of claim 1 including a system for quick recovery from arcing and sparkover conditions having:

a high voltage unidirectional-current power supply connected to said corona discharge electrode and said plate electrode to impress a high operating voltage thereacross to create an electric field and a corona current between the corona discharge electrode and the plate electrode, said power supply including protective circuitry for automatically opening the circuit between the power supply and the ionizer during arcing and sparkover conditions to quench any arcs and sparkovers and then automatically closing said circuit, and means for maintaining the voltage across the discharge and plate electrodes above some predetermined level for a predetermined length of time but without supplying sufficient current to the ionizer to maintain an arc or sparkover for the predetermined length of time, whereby the voltage across the discharge and plate electrodes quickly recovers to the operating voltage once any arcs and sparkovers are quenched and the circuit between the ionizer and the power supply is reclosed.

42. A system as set forth in claim 41 wherein the ionizer has a distributed capacitance of no more than 0.01 micro-F.

43. A system as set forth in claim 41 wherein the maintaining means includes a capacitance connected across the discharge and plate electrodes.

44. A system as set forth in claim 43 wherein the capacitance connected across said electrodes is substantially greater than the distributed capacitance of the ionizer.

45. A system as set forth in claim 43 wherein the maintaining means includes a resistance connected in series with the capacitance across the discharge and plate electrodes.

46. A system as set forth in claim 45 further including a high voltage high voltage diode biased forwardly during non-arcing conditions and connected in series with the capacitance and the resistance.

47. A system as set forth in claim 45 wherein the RC time constant of the resistance and capacitance is in the range of from approximately 16 msec to approximately 900 msec.

48. A system as set forth in claim 47 wherein said RC time constant is in the range of from approximately 75 msec to approximately 500 msec.

49. A system as set forth in claim 48 wherein said RC time constant is approximately 300 msec.

50. Apparatus as set forth in claim 44 wherein the maintaining means further includes a diode biased forwardly during non-arcing conditions and connected in series with the capacitance across the discharge and plate electrodes.

51. A system as set forth in claim 50 wherein the polarity of the discharge electrode is negative.

52. Apparatus as set forth in claim 1 for collecting charged particles entrained in a gas stream, the polarity of the charges on substantially all of said particles being the same, further including a non-corona deflector electrode for connection to a first terminal of a high voltage, unipolar source, said first terminal having the same polarity as the charges on the particles, and at least one collecting plate disposed substantially parallel to the deflector electrode for connection to the other terminal of said source, said collecting plate and said deflector electrode having an air gap therebetween for passage of the gas stream in which the charged particles are entrained, whereby when said collecting plate and said deflector electrode are connected to said terminals they create an electrostatic field across said air gap for deflecting the charged particles in the air gap toward said collecting plate, said deflector electrode including at least one conductor for connection to said first terminal and separated from the air gap by a layer of dielectric material having a dielectric constant greater than that of air, whereby sparkover between the deflector electrode and the collecting plate is suppressed and high electrostatic fields therebetween are achieved.

53. Apparatus as set forth in claim 52 wherein the dielectric material is an electret, whereby an electrostatic field is maintained across the air gap even during temporary collapse of the voltage from the high voltage source.

54. Apparatus as set forth in claim 52 wherein the dielectric material has a dielectric constant of from approximately 2.5 to approximately 9.

55. Apparatus as set forth in claim 52 wherein the conductor is embedded in the dielectric material.

56. Apparatus as set forth in claim 52 wherein the conductor is generally planar and is disposed generally parallel to the collecting plate.

57. Apparatus as set forth in claim 52 wherein the deflector electrode includes a plurality of generally parallel planar conductors separated from each other by layers of the dielectric material, said planar conductors being substantially parallel to the collecting plate, the planar conductor nearest the air gap being separated from the air gap by a layer of dielectric material.

58. Apparatus as set forth in claim 57 wherein the planar conductor nearest the air gap is insulated from any conductor in the deflector electrode which is adapted to be directly connected to the high voltage source.

59. Apparatus as set forth in claim 52 further including a second collector plate disposed generally parallel to the first collector plate for connection to said other terminal of the high voltage source, said deflector electrode being generally planar and disposed intermediate said first and second collector plates with generally equal sized air gaps between the deflector electrode and each plate for passage of the gas stream therethrough, the conductor of the deflector electrode being generally planar and embedded in the dielectric material, whereby sparkover between the deflector electrode and the collecting plates is suppressed and high electrostatic fields for deflection of the charged particles are achieved between the deflector electrode and each of said plates.

60. Apparatus as set forth in claim 59 wherein said parallel collector plates and deflector electrode constitute a first collecting section, further including a plurality of additional collecting sections substantially identical to the first collecting station.

61. Apparatus as set forth in claim 60 wherein the collecting sections are disposed in at least one bank to provide a plurality of parallel paths for the gas stream.

62. Apparatus as set forth in claim 59 wherein the deflector electrode includes at least first and second spaced-apart planar conductors, said conductors being generally parallel to the collecting plates and embedded in the dielectric material, the distance from the first conductor to the first collecting plate being approximately the same as the distance from the second conductor to the second collecting plate.

63. Apparatus as set forth in claim 62 wherein the deflector electrode includes at least a third conductor generally parallel to the first and second conductors and adapted to be connected to the high voltage source, said first and second conductors being insulated from said third electrode by layers of the dielectric material.

64. Apparatus as set forth in claim 52 wherein the dielectric material has a volume resistivity of at least $10^7$ ohms-cm.

65. Apparatus as set forth in claim 64 wherein the dielectric material has a volume resistivity of at least $10^{13}$ ohms-cm.

66. Apparatus as set forth in claim 52 further including a high voltage, unipolar power supply connected to said deflector electrode and said collector plate.

67. Apparatus as set forth in claim 66 wherein the collector plate is connected to the ground terminal of the power supply.

68. Apparatus as set forth in claim 67 wherein the deflector electrode is connected to a high negative polarity terminal of the power supply.

* * * * *

UNITED STATES PATENT AND TRADEMARK OFFICE

CERTIFICATE OF CORRECTION

PATENT NO. : 4,265,641

DATED : May 5, 1981

INVENTOR(S) : Subbiah Natarajan

It is certified that error appears in the above-identified patent and that said Letters Patent are hereby corrected as shown below:

In column 12, line 2, "in" should read --is--.

In column 14, line 34, "stream" should read --system--.

In column 14, line 41, "feed" should read --feet--.

In claim 12, line 1, delete the word "claim 1" and insert therefore -- claim 11--.

In claim 13, line 1, delete the word "claim 1" and insert therefore --claim 11--.

In claim 16, line 1, delete the word "claim 1" and insert therefore -- claim 17--.

In claim 19, line 1, delete the word "claim 1" and insert therefore --claim 11--.

In claim 21, line 1, delete the word "claim 1" and insert therefore --claim 11--.

UNITED STATES PATENT AND TRADEMARK OFFICE

CERTIFICATE OF CORRECTION

PATENT NO. : 4,265,641

DATED : May 5, 1981

INVENTOR(S) : Subbiah Natarajan

It is certified that error appears in the above-identified patent and that said Letters Patent are hereby corrected as shown below:

In claim 30, line 1, delete the word "claim 1" and insert therefore --claim 11--.

In claim 41, line 1, delete the word "claim 1" and insert therefore --claim 11--.

In claim 50, line 1, delete the word "claim 44" and insert therefore --claim 43--.

In claim 52, line 1, delete the word "claim 1" and insert therefore --claim 11--.

In claim 60, line 5, delete the word "station" and insert therefore --section--.

Signed and Sealed this

*Fifteenth* Day of *September 1981*

[SEAL]

*Attest:*

GERALD J. MOSSINGHOFF

*Attesting Officer*

*Commissioner of Patents and Trademarks*